United States Patent [19]

Hohnerlein, Jr. et al.

[11] 4,351,672

[45] Sep. 28, 1982

[54] REMOVAL OF OBJECTIONABLE FLAVOR AND ODOR CHARACTERISTICS IN FINISHED SUGAR PRODUCTS PRODUCED FROM MOLASSES

[75] Inventors: Otto G. Hohnerlein, Jr., Savannah; Willie E. Smith, Jr., Tybee Island; Nicholas T. Rimedio, Sr., Savannah, all of Ga.

[73] Assignee: Savannah Foods & Industries, Inc., Savannah, Ga.

[21] Appl. No.: 205,515

[22] Filed: Nov. 10, 1980

[51] Int. Cl.[3] ..... C13D 3/14

[52] U.S. Cl. ..... 127/46.3; 127/46.1

[58] Field of Search ..... 127/46 B, 42, 46 A, 127/46.3, 46.2, 46.1; 210/916; 426/271

[56] References Cited

U.S. PATENT DOCUMENTS

| | | | |
|---|---|---|---|
| 637,004 | 11/1899 | Kitsee | 127/48 |
| 1,591,879 | 7/1926 | Ochi et al. | 127/52 |
| 1,826,655 | 10/1931 | Ehrhart et al. | 127/52 |
| 1,989,156 | 1/1935 | Sanchez | 127/48 |
| 3,711,329 | 1/1973 | Zievers | 127/46 B |
| 3,730,770 | 5/1973 | Zievers et al. | 127/46 A |
| 3,884,714 | 5/1975 | Schneider et al. | 127/46.3 |
| 4,046,590 | 9/1977 | Riffer | 127/46 B |

FOREIGN PATENT DOCUMENTS

| | | | |
|---|---|---|---|
| 52-64435 | 5/1977 | Japan | 127/46 A |

*Primary Examiner*—Peter Chin

*Attorney, Agent, or Firm*—Cushman, Darby & Cushman

[57] ABSTRACT

A method is disclosed whereby the sugar portion of ion excluded molasses is treated with a halogen or a nascent halogen agent in order to remove the objectionable flavor and odor characteristics normally associated with raw cane juice. The method generally comprises treating the sugar portion of ion excluded molasses according to the steps of:

(a) subjecting the sugar portion of ion excluded molasses to gross decolorization;

(b) purifying the solution treated according to step (a) to remove all remaining impurities; and (c) concentrating or evaporating the purified sugar portion so that the percent of dry solids in solution is substantially increased to obtain a high quality sugar product which conforms to or exceeds existing standards for such sugar products, the method being further characterized by subjecting the sugar portion prior to concentrating or evaporating to the steps comprising:

(i) treating the decolorized sugar portion obtained in step (a) with a halogen or a nascent halogen agent so that the sugar portion is acidified to a point lower than its naturally occurring pH;

(ii) removing excess free halogen from the sugar portion treated according to step (i) to render the sugar portion free from objectionable flavor and odor characteristics.

15 Claims, No Drawings

REMOVAL OF OBJECTIONABLE FLAVOR AND ODOR CHARACTERISTICS IN FINISHED SUGAR PRODUCTS PRODUCED FROM MOLASSES

BACKGROUND OF THE INVENTION

Historically, the sugar cane plant has been cultivated for its sweetness. This sweetness is a result of the relatively high concentration of sucrose in the plant. Throughout history, man has worked to extract and then purify the sucrose contained in raw cane juice by utilizing crystallization techniques which result in the production of raw sugar, molasses, or mixtures thereof.

Heretofore, traditional processing techniques have attempted to maximize the quantities of raw sugar when treating raw cane juice. The carbohydrates contained in the molasses have a lower economic value when compared to the sugar contained in the raw sugar produced from cane juice. The lower economic value of the carbohydrates contained in molasses is a result of the economic limitations on extracting these carbohydrates therefrom. Current uses of the molasses include, but are not limited to animal feeds, feedstocks for certain chemical processes or the like. Therefore, it is prevalent in the industry to maximize the production of raw sugar while minimizing the production of molasses to take advantage of the higher economic value associated therewith.

Recently, however, certain processes have been disclosed which enable the sugars present in the molasses to be separated from the non-sugars contained therein in an economical manner. Such processes have been disclosed, for example, in U.S. Pat. Nos. 3,975,205 and 3,884,714. These processes are generally referred to in the industry as molasses desugarization processes. In general terms, the molasses desugarization process includes pretreating the molasses to lower the organic and inorganic non-sugars contained in the molasses, and separating the sugar and non-sugar portions of the molasses by passing the molasses over suitable ion exchange resins according to ion exclusion techniques.

In the course of producing a finished sugar product from the sugar portion of the ion excluded molasses, it is essential that objectionable flavor and odor characteristics are removed to ensure that the finished sugar product thus produced will meet or exceed existing standards for such products. It may be possible to achieve certain quantities of suitable finished sugar product by passing the sugar portion of ion excluded molasses over conventional ion exchange materials, such as, for example, animal bone char, commercial carbons, carbonaceous adsorbents or the like. However, these processes are economically disadvantageous due to the reduced volumes of acceptable finished sugar product obtained.

The nature of the sugar cane plant is such that the objectionable flavor and odor characteristics are inherent in the plant and are such that the conventional methods described above are not adequate to completely remove these characteristics from a sugar product produced from ion excluded molasses. Thus, while these inherent flavor and odor characteristics can be substantially removed through the use of the above-described conventional methods, the objectionable flavor and odor characteristics remain in trace amounts or greater even when such conventional methods are utilized.

It has now been discovered that the treatment of the sugar portion produced from the ion exclusion of molasses by a halogen or a nascent halogen agent will completely remove even trace amounts of objectional flavor and odor characteristics associated with the production of a finished sugar product. The method according to the present invention is both economically feasible from a manufacturing viewpoint and produces a finished sugar product which conforms to or exceeds existing standards for such products.

Heretofore, halogen or nascent halogen agents have been used only as an oxidizing agent for the decoloration of sugar solutions, as for example, U.S. Pat. Nos. 637,004; 1,591,879, 1,989,156 and 1,826,655. The chlorine disclosed in the above listed patents is generally utilized for the decolorization of raw sugar solutions such that crystalline sugar produced therefrom will be substantially color free. Additionally the chlorine may be utilized as a decolorizing agent according to the above patents when treating raw cane juice and producing raw sugar therefrom.

Therefore, it is a primary object of the present invention to provide a high quality finished sugar product which is completely free of the objectionable flavor and odor characteristics normally associated with cane juice which conforms to or exceeds all existing standards for finished sugar products.

It is a further object of this invention to provide an economical method for removing the objectionable flavor and odor characteristics in a finished sugar product produced from the desugarization of molasses.

These and other objects of the present invention will be more apparent from the discussion which follows.

SUMMARY OF THE INVENTION

The present invention further relates to a process for producing a high-quality finished sugar product by treating the sugar portion of ion excluded molasses by a halogen or a nascent halogen agent. The present invention provides for the addition of a halogen or a nascent halogen agent during conventional processing steps such that the objectionable flavor and odor characteristics normally associated with raw cane juice are eliminated. These objectional flavor and odor compounds which are present in trace quantities in the finished sugar product may be removed completely by utilizing the present invention. Thus, the key feature of the present invention is the addition or treatment of sugar-containing solutions in the form of sucrose, glucose, fructose, or mixtures thereof by a halogen or a nascent halogen agent. The finished sugar product which results is one that will conform to or exceed all existing standards for a high quality finished sugar product.

Molasses desugarization enables sugar producers to separate the valuable carbohydrates from the organic and inorganic non-sugar portions. The sugar portion which contain these valuable carbohydrates can be further treated to produce a finished sugar product. It is the sugar portion of the ion excluded molasses which is preferably treated according to the present invention.

Methods which may be utilized according to the present invention for molasses desugarization generally comprise the steps of:

(a) producing raw sugar, molasses or mixtures thereof from raw cane juice;

(b) separating the molasses from the mixture of step a);

(c) pretreating the separated molasses to substantially reduce the organic and inorganic non-sugar contents; and (d) ion excluding the pretreated molasses which yields a sugar portion and a non-sugar portion.

During the process of molasses desugarization to obtain a sugar and a nonsugar portion, it is necessary to introduce water prior to and during the process steps of ion exclusion so that the sugar and nonsugar portions will be adequately separated. The sugar portion separated during ion exclusion will, thus, be aqueous in nature.

The present invention generally provides:

(a) subjecting the sugar portion of ion excluded molasses to gross decolorization;

(b) purifying the solution treated according to step a) to remove all remaining impurities; and (c) concentrating or evaporating the purified sugar portion so that the percent of dry solids in solution is substantially increased to obtain a high quality sugar product which conforms to or exceeds existing standards for such sugar products, the method being further characterized by subjecting the sugar portion prior to concentrating or evaporating to the steps comprising:

(i) treating the sugar portion with a halogen or a nascent halogen agent so that the sugar portion is acidified to a point lower than its naturally occurring pH;

(ii) removing excess free halogen from the sugar portion treated according to step (i) to render the sugar portion free from objectionable flavor and odor characteristics.

More specifically, the preferred sequence of processing steps according to the present invention when treating the sugar portion of ion excluded molasses generally comprise:

(a) subjecting the sugar portion of ion excluded molasses to gross decolorization;

(b) treating the deolorized sugar portion with a halogen or nascent halogen agent;

(c) removing excess free halogen from the halogen or nascent halogen treated sugar portion;

(d) purifying the sugar portion treated according to step c); and (e) concentrating or evaporating the purified sugar portion to obtain a high quality sugar product free from objectional flavor and odor compounds which conforms to or exceeds existing standards for a high quality finished sugar product.

While the process steps indicate the preferred sequence of the present invention, it should be understood that the treatment of the sugar portion of ion excluded molasses with a halogen or a nascent halogen agent can occur at any time prior to concentration or evaporation. However, from an economical aspect, the halogen treatment preferably should occur at some point after the molasses has been ion excluded and separated into the sugar and nonsugar portions so that the halogen or the nascent halogen agent is not unnecessarily exhausted in the treatment of soil, dirt, foreign matter or excess impurities, including organic and inorganic nonsugars contained in the molasses.

DETAILED DESCRIPTION OF THE INVENTION

Gross Decolorization

The purpose of subjecting the sugar portion of ion excluded molasses to gross decolorization is to substantially reduce the organic non-sugars contained therein. Subjecting the sugar portion to such gross decolorization economizes the addition of the halogen or the nascent halogen agent such that the agent will not be unnecessarily exhausted in treating excess impurities including the organic and inorganic non-sugars.

The sugar portion of the ion excluded molasses is subjected to gross decolorization by passing the sugar portion over an ion exchange resin which has the property of removing from the sugar portion the organic non-sugars contained therein. Various suitable ion exchange resins exist in the industry, such as, for example, Rohm & Haas IRA 900. Additionally, other acceptable methods of gross decoloration exist such as, subjecting the sugar portion to such materials as animal bone char, commercial carbons in either powdered or granular form, or carbonaceous adsorbent resins.

The sugar portion of ion excluded molasses when subjected to the process of gross decolorization reduces the organic non-sugars present therein as color pigments and produces a substantially colorless solution.

Treating with a Halogen or a Nascent Halogen Agent

Treating the sugar portion of ion excluded molasses with a halogen or a nascent halogen agent is an essential part of this invention. The purpose of treating the sugar portion according to the present invention is to completely eliminate objectionable flavor and odor characteristics normally associated with raw cane juice. The treatment with a halogen or nascent halogen agent can, theoretically, be accomplished at any time prior to evaporation or concentration. However, as noted above, the presence of soil, dirt, foreign matter, or excess impurities including organic and inorganic nonsugars in the molasses would unnecessarily exhaust the halogen or the nascent halogen agent, thereby increasing cost. Therefore, the preferred embodiment of this invention is to treat the sugar portion of ion excluded molasses with a halogen or a nascent halogen agent after the molasses has been ion excluded, and preferably after the sugar portion has been subjected to gross decolorization, but before evaporation or concentration.

A halogen agent as used according to the present invention can be in the form of a free halogen in the diatomic molecular gaseous state, such as, for example, the diatomic molecules of chlorine, bromine, iodine or fluorine, and preferably chlorine. These diatomic molecular halogens in the gaseous state exhibit similar disassociation properties when introduced into an aqueous solution. A nascent halogen agent as used according to the present invention can be any compound that will exhibit disassociation properties similar to the diatomic molecular halogens mentioned above, when such nascent halogen agent is introduced into an aqueous solution. Examples of nascent halogen agents which may be utilized according to the present invention are sodium hypochlorite, calcium hypochlorite or the like.

The halogen or nascent halogen agent utilized by the present invention can be, for example, chlorine gas, sodium hypochlorite, or the like. Preferably, chlorine gas is utilized and can be contacted with the ion excluded molasses sugar portion in solution by any conventional industrial means such as, gas injection, gas diffusion or the like. The sugar portion preferably should be agitated or subjected to mechanical mixing during the introduction of the gaseous chlorine. The solution will necessarily be acidified upon the addition of the chlorine gas such that the pH of the solution is reduced to a value of not greater than 2.5, preferably 2.0.

It has thus been found that when the sugar portion of ion excluded molasses is treated with a halogen or a nascent halogen agent, such as, for example, chlorine gas, according to the present invention, the trace quantities of objectionable flavor and odor compounds normally associated with raw can juice are completely removed from the finished sugar product thereby conforming to or exceeding existing standards for finished sugar products. The resulting product is virtually odor free and exhibits a sweet taste with no objectionable flavor.

The pH of the solution can be subsequently raised by any conventional method including the addition of an alkaline agent. However, it has been found that the solution pH is satisfactorily raised during subsequent purification according to conventional ion exchange techniques. Raising the pH of the solution in this manner obviates the use of an additional chemical agent in the treatment of the solution, and thus, is the preferred method according to the present invention.

REMOVING EXCESS FREE HALOGEN

Due to the chemical incompatibility of certain ion exchange resins with free halogens, more specifically chlorine, it is necessary to remove the excess free halogen prior to passing the halogen treated solution over such ion exchange resins for the purpose of further purification. The removal of free chlorine can be accomplished according to conventional technology by contacting the chlorine treated solution with activated carbons. The process of removing excess free halogen by passing the halogen treated solution over activated carbon has the additional advantage of removing a portion of the remaining organic nonsugars such that the solution is further decolorized.

PURIFICATION

Purification is needed to effectively remove all remaining impurities so as to produce a finished sugar product that meets or exceeds all existing standards for pure sugar. These standards specify that the sugar should be practically free of color, inorganic ash, organic non-sugars, undesirable odors and flavors, and visual particulate matter or sediment.

The following procedure is offered as a guideline as to the extent of the treatment necessary to purify the sugar solution. While this is by no means the only way to achieve purification, it is believed that others will only be modifications of this scheme. This scheme consists of:

(1) Additional gross decolorization by use of decolorizing ion exchange resins;

(2) Filtration of the sugar solution to remove any visual particulate or sediment;

(3) Treatment of the sugar solution with animal bone char, commercial carbons (granular or powdered) or carbonaceous adsorbent resins;

(4) Passing the solution over cation/anion exchangers.

The treatment with a halogen or a nascent halogen agent as discussed above necessarily purifies the sugar solution with respect to the objectionable flavor and odor compounds according to the present invention.

EVAPORATION OR CONCENTRATION

The evaporation or concentration step is carried out so as to increase the dry solids level of the pure sugar to any desired degree and in preferably at least 70% in the finished product. Evaporation can be accomplished by conventionally known techniques. There are several methods available for commercial large scale evaporation, all of which should be acceptable according to the present invention, including, but not limited to, liquid concentration and spray drying.

EXAMPLE 1 (Comparative)

A predetermined volume of the sugar portion obtained from ion excluded molasses produced according to conventional molasses desugarization methods was decolorized using a specific decolorizing resin. The molasses was passed directly over a commercial granular carbon adsoprtion chamber, ion exchanged and evaporated to yield a finished product typical of that obtained from utilizing conventional processes. The finished sugar product exhibited noticeable objectional flavor and odor characteristics.

EXAMPLE 2

An equal volume of the sugar portion obtained from ion excluded molasses to that examined in Example 1 above, was similarly decolorized using a specific decolorizing resin. However, in this example, the equal volume of the sugar portion was subjected to chlorination with chlorine gas by bubbling the gas directly through the sugar portion until the pH of the molasses was lowered to 2.0. The chlorinated molasses was subsequently passed directly over a commercial granual carbon adsorption chamber, ion exchanged and evaporated to yield a finished product in accordance with the present invention. The finished sugar product exhibited a neutral pH, or about 7.0. Organoleptic evaluations of the finished sugar product prepared in accordance with this example disclosed a complete absence of objectional flavor and odor characteristics normally associated with raw cane juice.

The invention having been thus particularly and distinctly described, it will be appreciated that same may comprise, consist or consist essentially of the hereinabove recited steps and materials. Furthermore, while the invention has been herein described in what is presently conceived to be the most practical and preferred embodiment thereof, it will be apparent to those of ordinary skill in the art that modifications may be made thereof within the scope of the invention, which scope is to be accorded the broadest interpretation of the appended claims so as to encompass all equivalent methods.

What is claimed is:

1. A method for removing undesirable flavor and odor characteristics in a finished sugar product produced from the ion exclusion of molasses which yields sugar and non-sugar portions and wherein the sugar portion is treated according to the steps comprising:

(a) subjecting the sugar portion of ion excluded molasses to gross decolorization;

(b) purifying the solution treated according to step (a) to remove all remaining impurities; and (c) concentrating or evaporating the purified sugar portion so that the percent of dry solids in solution is substantially increased to obtain a high quality sugar product which conforms to or exceeds existing standards for such sugar products, the method being further characterized by subjecting the sugar portion prior to concentrating or evaporating to the steps comprising:

(i) treating the sugar portion with a halogen or a nascent halogen agent so that the sugar portion is acidified to a point lower than its naturally occurring pH;

(ii) removing excess free halogen from the sugar portion treated according to step (i) to render the sugar portion free from objectionable flavor and odor characteristics.

2. A method according to claim 1 wherein steps (i) and (ii) are practiced after subjecting the sugar portion to gross decolorization and prior to purifying.

3. A method according to claim 1 wherein the step (i) is carried out with chlorine gas.

4. A method according to claim 1 wherein the step (i) is carried out with a nascent halogen agent which is sodium hypochlorite.

5. A method according to claim 1 wherein the solution treated according to step (i) is acidified so that the pH of said solution is between about 1.5 and 2.5.

6. A method according to claim 1 wherein the solution treated according to step (i) is acidified so that the pH of said solution is not greater than 2.5.

7. A method according to claim 1 wherein the solution treated according to step (i) is acidified so that the pH of said solution is 2.0.

8. A method according to claim 1 wherein step (ii) is carried out by passing the sugar portion over activated carbon.

9. A method according to claim 1 wherein gross decolorization according to step (a) is accomplished by passing the sugar portion of ion excluded molasses over decolorizing resins.

10. A method according to claim 1 wherein step (b) is practiced by subjecting the solution to filtration.

11. A method according to claim 1 wherein step (b) is practiced by passing the solution through cation and anion exchange resins.

12. A method according to claim 1 wherein step (c) is practiced by spray drying.

13. A method according to claim 1 wherein the percent of dry solids in solution evaporated or concentrated according to step (c) is about 70%.

14. A method according to claim 3 wherein the chlorine gas is contacted with the sugar portion by directly injecting the chlorine in a gaseous state therein.

15. A method according to claim 14 wherein the sugar portion is continuously agitated during the injection of gaseous chlorine.

* * * * *